United States Patent [19]

Togoshi

[11] Patent Number: 5,042,279

[45] Date of Patent: Aug. 27, 1991

[54] BENDING MACHINE

[75] Inventor: Hideyuki Togoshi, Nishinomiya, Japan

[73] Assignee: Chiyoda Kogyo Co., Ltd., Osaka, Japan

[21] Appl. No.: 590,561

[22] Filed: Sep. 28, 1990

Related U.S. Application Data

[63] Continuation of Ser. No. 418,905, Oct. 5, 1989, abandoned, which is a continuation of Ser. No. 268,645, Nov. 7, 1988, abandoned, which is a continuation of Ser. No. 115,591, Oct. 26, 1987, abandoned, which is a continuation of Ser. No. 14,153, Feb. 12, 1987, Pat. No. 4,264,913, which is a continuation of Ser. No. 761,626, Aug. 1, 1985, abandoned.

[51] Int. Cl.[5] ..... B21D 7/04

[52] U.S. Cl. ..... 72/29; 72/157

[58] Field of Search ..... 72/149, 150, 154–159, 72/307, 311, 320, 321, 8, 19, 28, 29, 30; 318/604

[56] References Cited

U.S. PATENT DOCUMENTS

| | | | |
|---|---|---|---|
| 3,147,792 | 9/1964 | Hautau | 72/157 |
| 3,974,676 | 8/1976 | Eaton | 72/307 |
| 4,063,441 | 12/1977 | Eaton | 72/155 X |
| 4,495,788 | 1/1985 | Traub | 72/157 |
| 4,537,053 | 8/1985 | Schwarze | 72/157 |

FOREIGN PATENT DOCUMENTS

| | | | |
|---|---|---|---|
| 1962590 | 6/1971 | Fed. Rep. of Germany | 72/157 |
| 2910174 | 9/1980 | Fed. Rep. of Germany | 72/157 |
| 59-178131 | 10/1984 | Japan | 72/157 |

*Primary Examiner*—E. Michael Combs

*Attorney, Agent, or Firm*—Jordan and Hamburg

[57] ABSTRACT

There is disclosed a bending machine adapted to bend a pipe and other such workpiece in three-dimensional directions. The bending machine comprises a first actuator for vertically moving bend dies to select one of the bend dies for use, and a second actuator for horizontally moving the bend dies. The second actuator comprises a servomotor.

9 Claims, 6 Drawing Sheets

BENDING MACHINE

This application is a continuation of application Ser. No. 418,905, filed Oct. 5, 1989, abandoned, which in turn is a continuation of application Ser. No. 268,645, filed Nov. 7, 1988, abandoned, which in turn is a continuation of application Ser. No. 115,591, filed Oct. 26, 1987, abandoned, which in turn is a continuation of application Ser. No. 014,153, filed Feb. 12, 1987. U.S. Pat. No. 4,264,913, which in turn is a continuation of application Ser. No. 761,626, filed Aug. 1, 1985, abandoned.

BACKGROUND OF THE INVENTION

The present invention relates to a bending machine for use in bending pipes, mainly water or oil pipes, at a plurality of positions longitudinally thereof. More particularly, the invention relates to a bending machine comprising means for feeding a length of workpiece as maintained in a predetermined posture to a bending section by advancing the workpiece axially thereof, a plurality of bend dies arranged coaxially with each other and adapted to bend a portion of the workpiece fed to the bending section to different curvatures, a first actuator for axially moving the bend dies to selectively place the bend dies in an operative position, and a second actuator for moving the bend dies together along a plane to selectively place the bend dies in the operative position on the plane.

This type of bending machine, which selects the bend die to be used by moving the bend dies relative to the workpiece feed means, has the advantage over the type of bending machine that selects the bend die to be used by moving the feed relative to the bend dies. The advantage resides in that, while the feed means tends to be large and heavy since the feed means often needs to be longer than the workpiece it supports, the actuator or actuators for selecting the bend die to be used and a support structure therefor can be of small and light design and hence low cost.

The type of bending machine having the above advantage conventionally has the second actuator comprising a hydraulic or pneumatic cylinder.

However, such a conventional bending machine still has room for improvement. The cylinder constituting the second actuator, though operable at slow speed, is very difficult to accurately stop at an intermediate position between stroke ends thereof from the point of view of control technique. This not only renders a bending operation time-consuming and inefficient but results in varying gaps between the workpiece and bend dies. Consequently, a twist of the workpiece and other inconveniences due to the presence of gaps make it difficult or impossible to bend the workpiece so as to follow peripheral surfaces of the bend dies, and hence poor bending precision. Furthermore, since it is very difficult to vary the cylinder stopping position intermediate between the stroke ends for reasons of control technique and cost, it is virtually impossible to replace the bend dies with those having different curvatures. The limitation to the variety of curvatures results in limination to use of the bending machine. Moreover, it is very difficult to operate the cylinder at variable speeds from the point of view of control technique and cost. Therefore, where, for example, in bending a workpiece including a projecting object 1*a* such as an attaching metal piece as shown in FIG. 8, one of the bend dies is moved to the operative position simultaneously with the introduction to the bending section of the workpiece portion carrying the projecting object in order to shorten the bending time for high working efficiency, the projecting object and the bend die tend to interfere with each other such as by colliding depending on the size and orientation of the projecting object. This inevitably results in an inefficient bending operation in which the workpiece portion carrying the projecting object is first fed into the bending section and then one of the bend dies is moved to the operative position.

SUMMARY OF THE INVENTION

The object of this invention is to eliminate the disadvantages of the prior art noted above.

In order to achieve this object the present invention provide a bending machine characterized in that the second actuator comprises a servomotor. The bending machine having such a characterizing feature produces the following functional effect.

The bend die whatever curvature it has is moved to the operative position speedily and accurately since the servomotor constituting the second actuator, though operable at high speed, is capable of accurately stopping at any position intermediate between stroke ends, readily varying the stopping position with the aid of its own position detecting function, and readily varying the operating speed. Furthermore, an object projecting from the workpiece is prevented from interfering or colliding with the bend dies by adjusting the moving speed of the bend dies where the bend dies are moved to the operative position simultaneously with the introduction of the workpiece portion having the projecting object for efficiency of the bending operation.

Thus, the present invention provides a bending machine with wide application, the machine being capable of a bending operation with very high efficiency, exchanging the bend dies with those having different curvatures to bend the workpiece to varied curvatures, and efficiently bending a workpiece having a projecting object.

Other advantages of the present invention will be apparent from the following description.

BRIEF DESCRIPTION OF THE DRAWINGS

The drawings illustrate a bending machine embodying this invention, in which.

DESCRIPTION OF THE PREFERRED EMBODIMENTS

Figure 1:
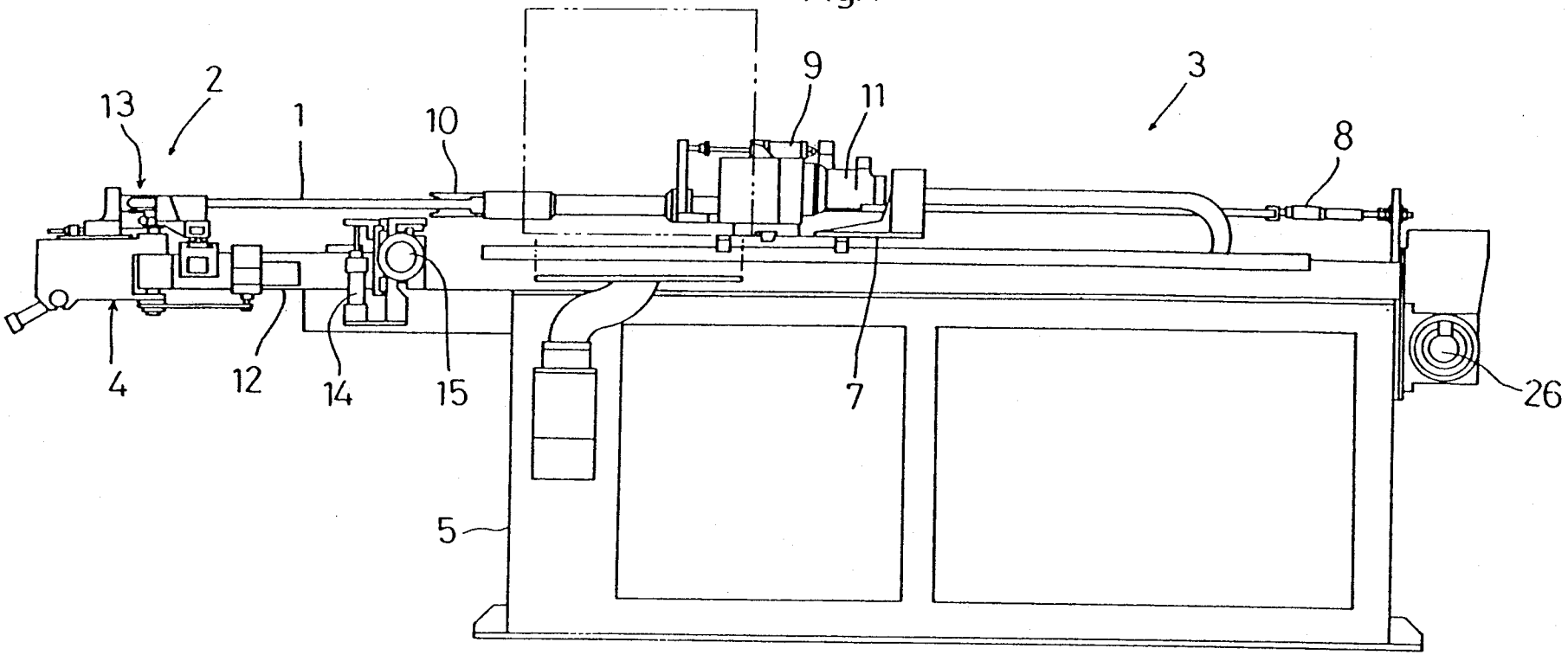
FIG. 1 is a side view of the bending machine.
Figure 2:
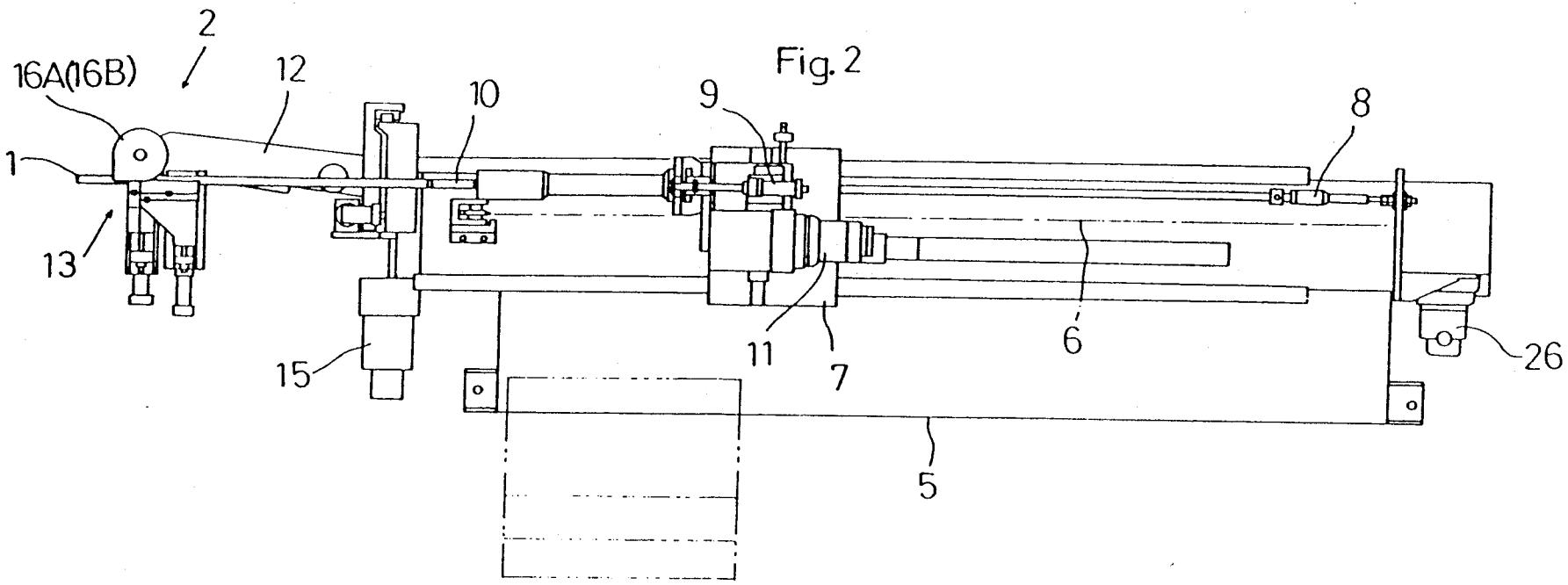
FIG. 2 is a plan view of the bending machine.
Figure 3:
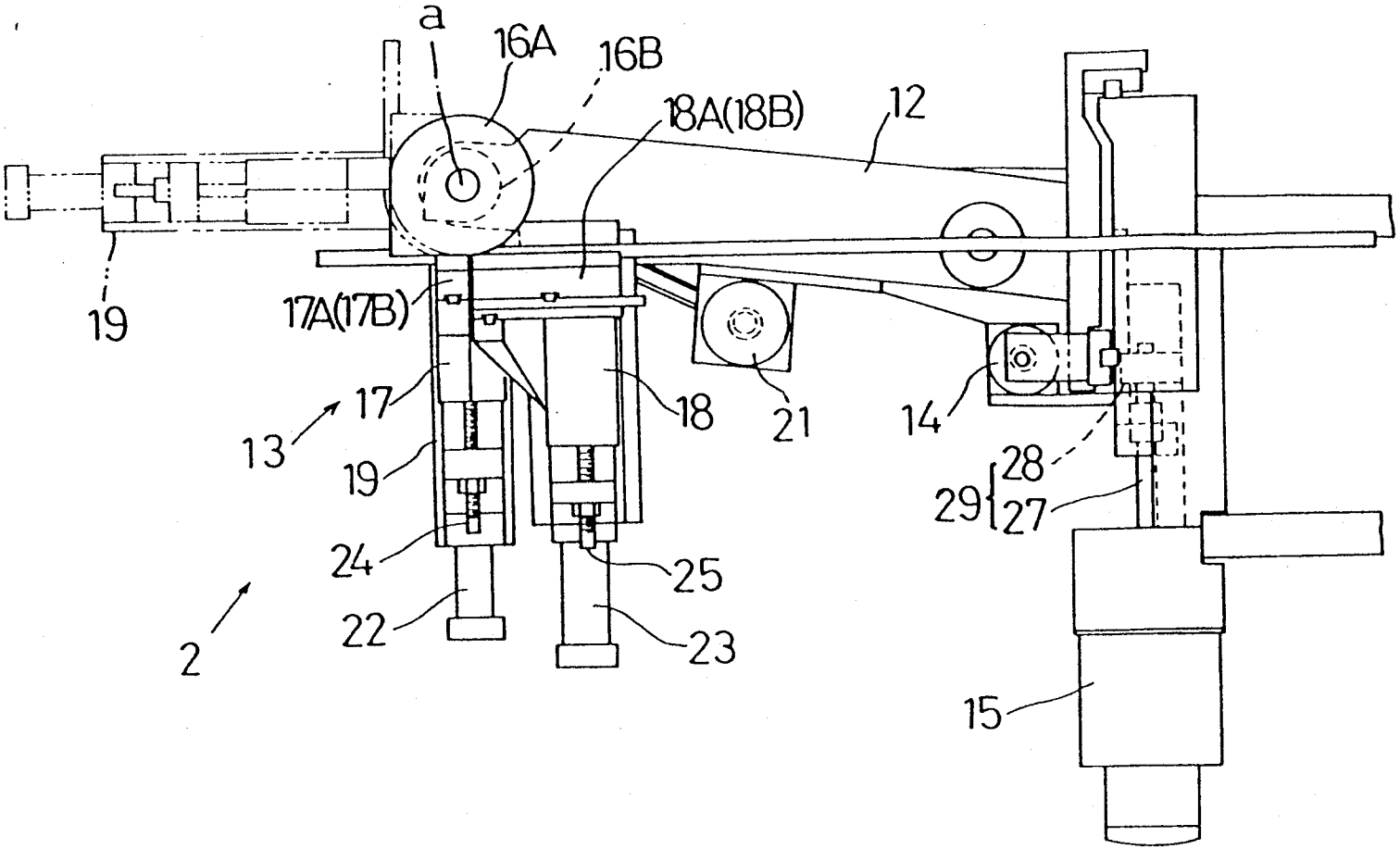
FIG. 3 is a plan view of the principal portion of the bending machine.

Referring to FIGS. 1 and 2, the automatic bending machine shown therein comprises a feed mechanism 3 for advancing a pipe 1 (which is an example of the length of workpiece to be bent) maintained in a horizontal posture along its axis to a bending section 2 of the machine, and a bending mechanism 4 for bending portions of the pipe 1 fed to the bending section 2 to predetermined curvatures and angles. The feed mechanism 3 and the bending mechanism 4 are operable under program controls.

The feed mechanism 3 includes a carriage and a mandrel 8 mounted on a base block 5 resting on a floor. The carriage 7 is driven by means of a chain 6 to move axially of the pipe 1. The mandrel 8 is adapted to engage a rear end of the pipe 1 so as to permit rotation on its axis but not axial movement of the pipe 1. The carriage 7 carries a chuck 10 for receiving and holding an intermediate portion of the pipe 1, a hydraulic cylinder 9 for switching the chuck 10 between a position to hold the pipe 1 and a position to release the pipe 1, and a DC servomotor 11 for rotating the chuck 10 about the axis of the pipe 1. Thus the pipe 1 is maintained in the horizontal posture by the mandrel 8 and the chuck 10 and is advanced axially by the carriage 7. The DC servomotor 11 is operable to rotate the pipe 1 as held by the chuck 10.

Referring to FIGS. 3 through 7, the bending mechanism 4 includes a frame 12 mounted on the base block 5 to be movable vertically and horizontally at right angles to the axis of the pipe 1. The frame 12 carries a bending assembly 13 adapted to bend a pipe portion fed to the bending section 2 in a righthand or lefthand direction on a horizontal plane, The bending assembly 13 being variable to provide different bend angles steplessly and bend curvatures in two steps. The bending mechanism 4 further includes a first actuator 14 for vertically moving the frame 12 and a second actuator 15 for horizontally moving the frame 12.

The bending assembly 13 includes two bend dies 16A and 16B arranged one on top of the other on a vertical axis a and having peripheral surfaces **16*a* and 16*b* of different curvatures. Each of the bend dies 16A and 16B is rotatable on the axis a while the peripheral surface 16*a* or 16*b* thereof is in pressure engagement with the pipe portion fed to the bending section 2 to draw the pipe portion and at the same time bend the pipe portion to a shape corresponding to the shape of the peripheral surface 16*a* or 16*b*. The bending assembly 13 further includes clamp dies 17A and 17B rotatable in unison with the bend dies 16A and 16B on the vertical axis a while holding the pipe portion against the opposed peripheral surfaces 16*a* and 16*b* of the bend dies. There are further provided pressure dies 18A and 18B movable with the pipe portion drawn by the bend dies 16A and 16B and adapted to press the pipe portion against the peripheral surfaces 16*a* and 16*b*** of the bend dies.

The bend dies 16A and 16B are removably attached to a swing frame 19 mounted on the frame 12 to be rotatable about the vertical axis a.

The clamp dies 17A and 17B are removably attached to a carrier 17 mounted by a link mechanism (not shown) on the swing frame 19 to be movable toward and away from the bend dies 16A and 16B. Thus the clamp dies 17A and 17B are movable with swinging movements of the carrier 17 between a position to hold the pipe portion against the bend dies and a position to release the pipe portion.

The pressure dies 18A and 18B are removably attached to a carrier 18 to be movable axially of the pipe 1, the carrier 18 being slidably mounted on the frame 12, as seen in FIG. 1, to be slidable toward and away from the bend dies 16A and 16B. Thus the pressure dies 18A and 18B are movable with the sliding movements of the carrier 18 between a position to press the pipe portion against the bend dies 16A and 16B and a position to release the pipe portion.

Number 20 denotes a hydraulic motor for causing the swinging movements of the swing frame 19. Number 21 denotes an encoder for detecting swing angles of teh swing frame 19, namely the bend angles. Number 22 denotes a hydraulic cylinder for moving clamp dies 17A and 17B between the pipe holding position and the release position. Number 23 denotes a hydraulic cylinder for moving the pressure dies 18A and 18B between the pipe pressing position and the release position. Number 24 denotes a screw for adjusting the pipe holding position of the clamp dies 17A and 17B in accordance with pipe diameters and other conditions. Number 25 denotes a screw for adjusting the pipe pressing position of the pressure dies 18A and 18B in accordance with pipe diameter and other conditions. Number 26 denotes a servomotor for driving the chain 6.

The first actuator 14 comprises a hydraulic cylinder for vertically moving the frame 12 relative to the feed mechanism 3, namely relative to the base block 5, in order to selectively place the bend die 16A or 16B at a height to engage the pipe portion. When the cylinder 14 is at one end of its stroke one of the bend dies 16A is placed at the pipe engaging height, and when the cylinder 14 is at the other end of its stroke the other bend die 16B is placed at the pipe engaging height.

The second actuator 15 comprises a servomotor for moving the frame 12 horizontally in right and left directions relative to the base block 5 in order to selectively place the bend die 16A or 16B in a position to engage the pipe portion or a position to cause the peripheral surface **16*a* or 16*b* to contact the pipe portion. The servomotor 15 is adapted to move and lock the frame 12 through a drive screw mechanism 29 comprising a screw 27 and a ball nut 28** in mesh therewith.

Figure 9:
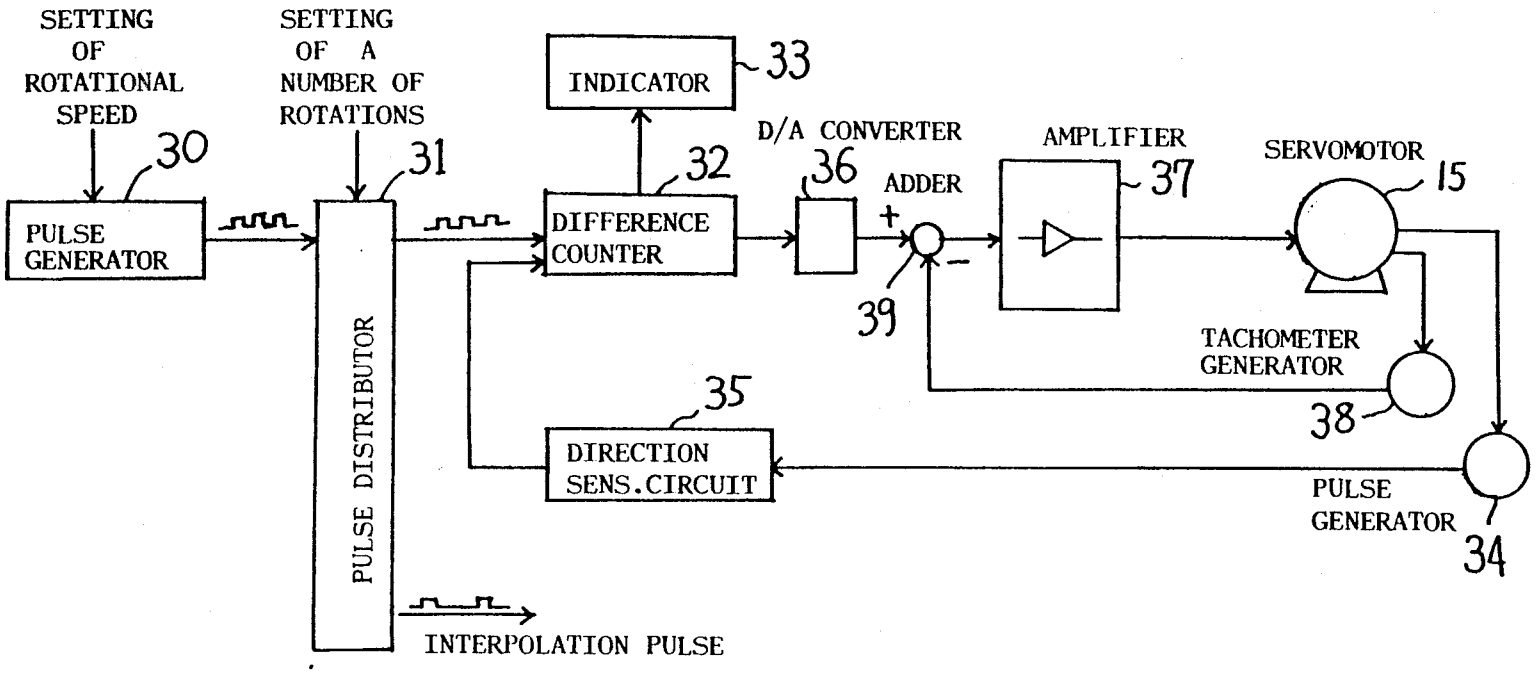
FIG. 9 is a block diaphragm of a control circuit for a servomotor.

The servomotor 15 is controlled by for instance a control circuit shown in FIG. 9. A pulse generator 30 generates pulses which are given to a pulse distributor 31. A rotational speed of the servomotor 15 is preset on the pulse generator 30, and a number of rotations and angles thereof are preset on the pulse distributor 31.

The pulse distributor divides the pulses noted above into two pulsed signals, one of them being interpolation pulses while the other being main pulsed signal transmitted to a difference counter 32. This counter 32 receives also a feedback signal from a further pulse generator 34 through a direction sensing circuit 35 so as to change a rotation angle signal to an indicator 33. An output signal from the counter 32 is transmitted to the servomotor 15 through a D/A (digital-analog) converter 36 and an amplifier 37.

A tachometer generator 38 provided on the servomotor 15 generates a signal representing a rotational speed of the servomotor. This signal is fed back to an adder 39 interposed between the D/A converter 36 and the amplifier 37. Thus, the servomotor 15 can always drive the frame 12 in a horizontal direction with a high accuracy even when dimensions of the bend dies 16A and 16B and clamp dies 17A and 17B are altered.

Figure 5:
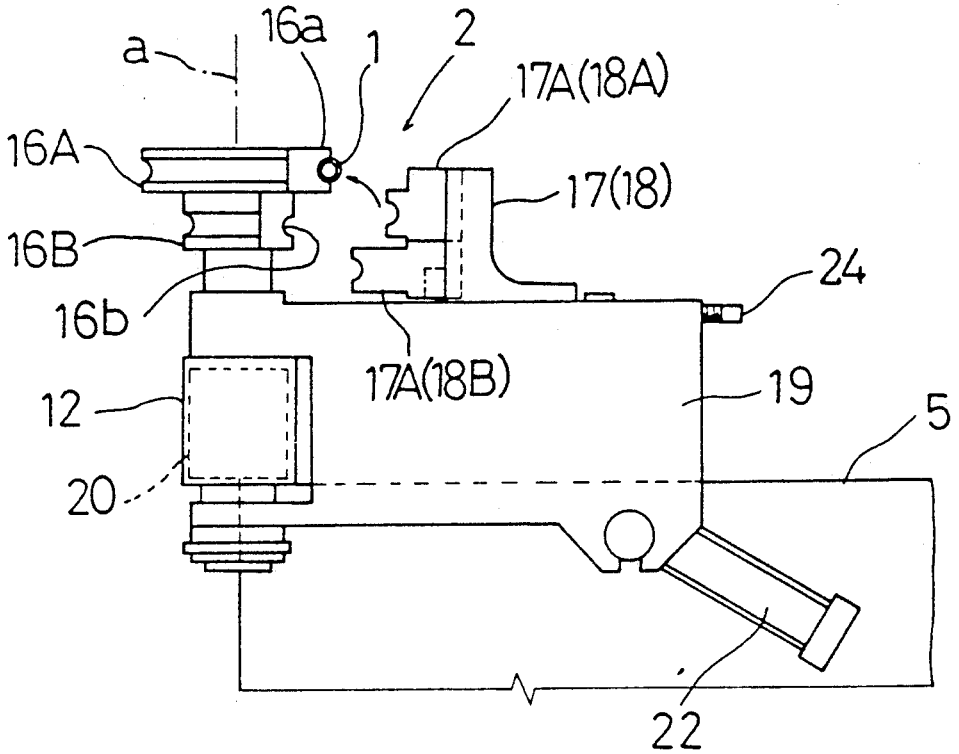
FIGS. 5 through 7 are enlarged front views of the principal portion each showing an operational mode thereof.
Figure 6:
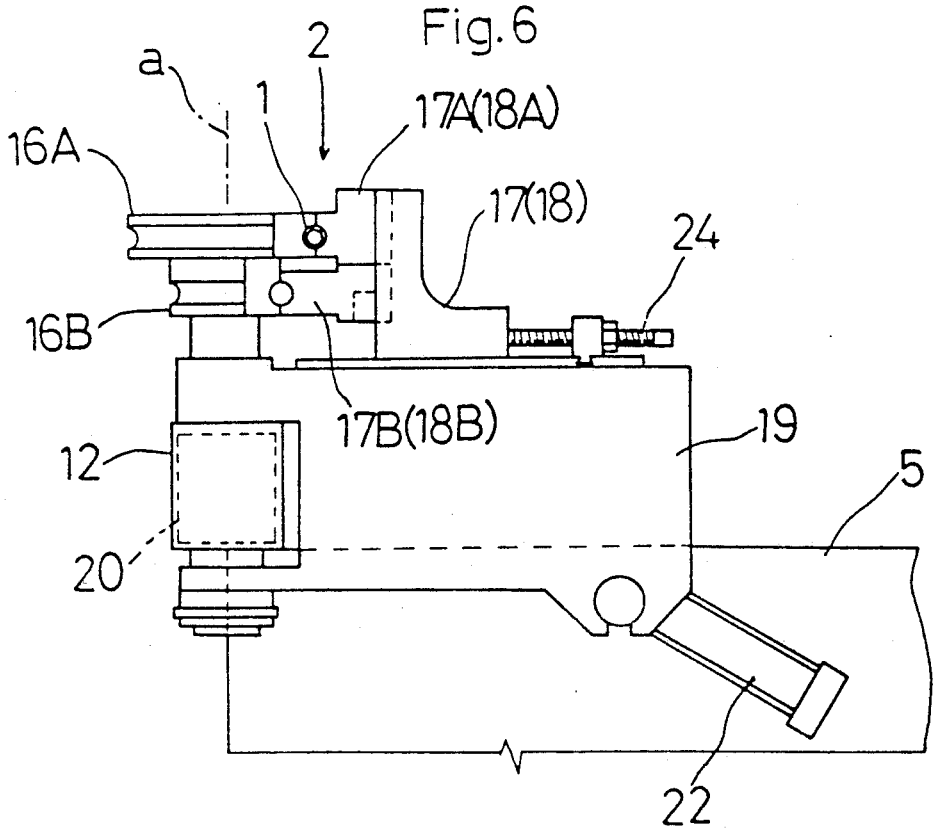
Figure 7:
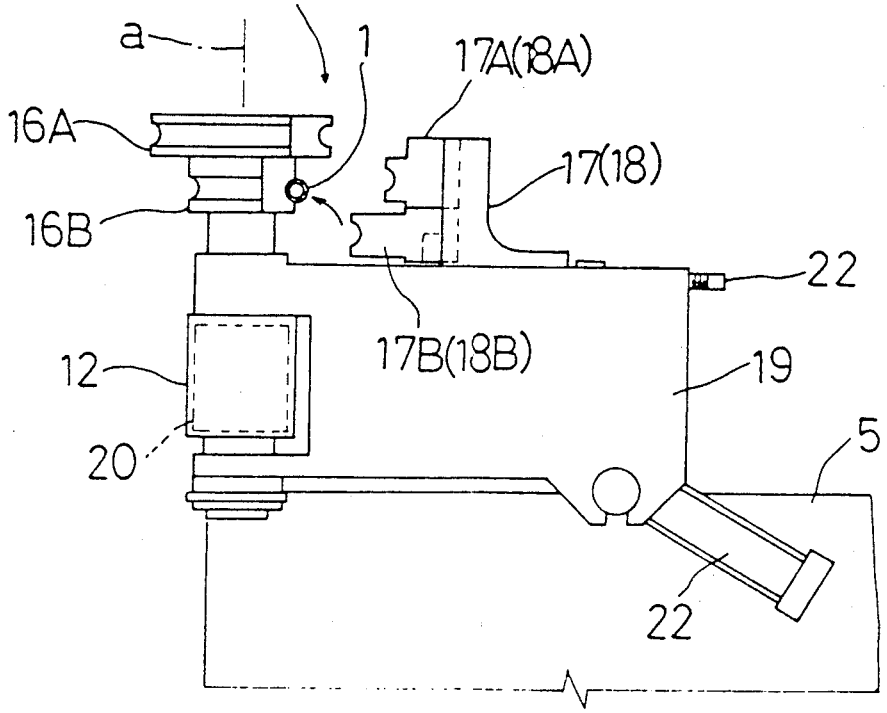
Figure 4:
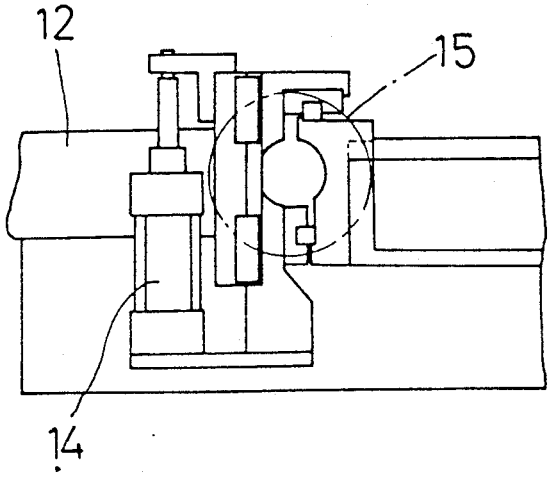
FIG. 4 is a side view of a principal portion of the bending machine.
Figure 8:
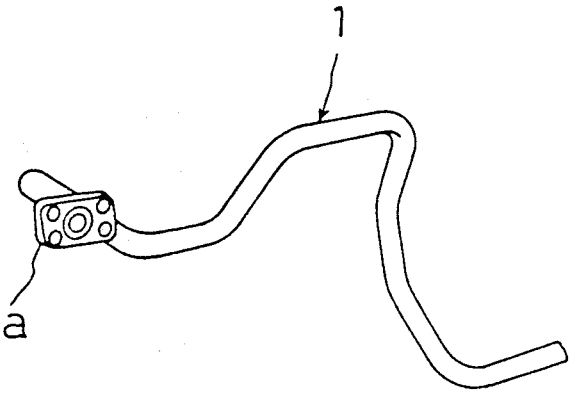
FIG. 8 is a perspective view of a pipe bend by the bending machine.

Referring to FIGS. 5 through 7, the described bending machine feeds the pipe 1 to the bending section 2, and moves the frame 12 by means of the first and second actuators 14 and 15 to place a selected one of the bend dies 16A and 16B in the pipe engaging position. Then the clamp dies 17A and 17B and the pressure dies 18A and 18B are brought to their respective operative positions. Thereafter the swing frame 19 is actuated to rotate the bend dies 16A and 16B and the clamp dies 17A and 17B together through a desired angle thereby to bend the pipe portion to desired curvature and angle. By turning the pipe 1 about its axis by means of the feed mechanism 3, the pipe 1 is bent in desired direction only by swinging the swing frame 19 in the right and left direction. The resulting pipe has bends in varied directions at a plurality of positions longitidinally thereof as shown in FIG. 8. The movement of the bend dices 16A and 16B by the first and second actuators 14 and 15 is effected simultaneously with the feeding of the pipe 1 to the bending section 2. Where the pipe 1 is provided with a projecting object 1*a* such as a washer, the second actuator 15 moves the bend dies at an adjusted speed when the portion of the pipe carrying the projecting object 1*a* is fed into the bending section 2, thereby preventing the bend dies 16A and 16B from colliding with the projecting object 1*a*.

The foregoing embodiment of the invention may be modified as follows:

(1) Three or more bend dies may be coaxially arranged to provide a single length of workpiece with bends of three or more different curvatures. In this instance the first actuator 14 comprises a servomotor.

(2) The bend dies 16A and 16B may be fixed against rotation, in which case only the clamp dies 17A and 17B are rotated about the axis of the bend dies in sliding engagement with the workpiece portion in order to bend the workpiece portion by pressing same against the peripheral surface 16*a* or 16*b*.

What is claimed is:

1. A bending machine comprising means for feeding a length of workpiece in a predetermined posture to a bending section by advancing said workpiece axially with respect to said workpiece, a fixed frame, a second frame, means for moving said second frame with respect to said fixed frame, said bending section comprising a plurality of bend dies mounted on a common axis for bending a portion of said workpiece in alignment therewith to curvatures dependent upon the die aligned therewith, and a swing frame pivoted to said second frame and supporting said bend dies, said means for moving said second frame comprising a first actuator for moving said second frame in a first direction parallel to the axis of rotation of said swing frame to selectively place said bend dies in alignment with said workpiece, and a second actuator for moving said second frame in a second direction perpendicular to said first direction to selectively place said bend dies in position to engage said workpiece, wherein said second actuator comprises an analog voltage driven servomotor, a source of drive pulses for rotating said servomotor through a predetermined angle, said source of drive pulses comprising a first pulse generator for generating first pulses, a second pulse generator for providing second pulses corresponding to the rotation of said motor, and a difference counter connected to receive said first and second pulses to output said drive pulses, and means for converting said drive pulses to analog form for application to said servomotor, whereby the speed of said motor corresponds to the rate of said first pulses, said first actuator comprising a hydraulic cylinder.

2. The bending machine of claim 1 wherein said bend dies are coaxially positioned with respect to one another, and further comprises a separate clamp die corresponding to each said bend die, said clamp dies being supported on said swing frame, whereby said clamp dies are selectively placed in position to engage said workpiece in alignment with their respective bend dies.

3. A bending machine adapted to bend a pipe, comprising:

a base block, a feed mechanism mounted for movement on said base block in a given direction, said feed mechanism including a carriage slidably mounted on the base block, a chuck mounted on said carriage and adapted to receive and hold the pipe to be bent, and means for operating the chuck between a pipe holding position and a pipe releasing position, a first frame and means for mounting said first frame on the base block so that the first frame can be moved vertically and horizontally perpendicular to said given direction, said mounting means comprising means between the first frame and the base block, said moving means including a first actuator for vertically moving the first frame and a second actuator for horizontally moving the first frame, said second actuator comprising an analog voltage driven servomotor, a source of drive pulses for rotating said servomotor through a predetermined angle, said source of drive pulses comprising a first pulse generator for generating first pulses, a second pulse generator for providing second pulses corresponding to the rotation of said motor, and a difference counter connected to receive said first and second pulses to output said drive pulses, and means for converting said pulses to analog form for application to said servomotor, whereby the speed of said motor corresponds to the rate of said first pulses, so that a horizontal position of the first frame relative to the base block can be changed easily and precisely adjusted, and a bending assembly connected to the first frame for bending a portion of a pipe, said bending assembly including at least one bend die, clamping die means adapted to clamp the pipe between the clamp die and the bend die, means for pivotally mounting said bend die and said clamping die means to said first frame for rotation about a given axis, means for rotating the bend die and the clamping die means for bending the pipe, and at least one pressure die adapted to push the pipe against the bend die, said pressure die being slidable relative to the first frame and not being pivotable about said axis so that while the rotating means is actuated to bend the pipe, the pipe is always pushed against the bend die to therby allow the pipe to be bent positively along the bend die, whereby the pipe retained by the chuck of the feed mechanism can be held and supported at an exact position as required by the bending assembly when moving the first frame for supporting the bending assembly by the moving means.

4. The bending machine of claim 3 wherein said pressure die is mounted on a carrier that is movable axially of said pipe.

5. The bending machine of claim 3 wherein said means for pivotally mounting comprises a swing frame.

6. The bending machine of claim 5 wherein said pressure die is mounted on a carrier that is mounted on said second frame to be slidable toward and away from said bend die.

7. The bending machine of claim 6 further comprising separate hydraulic motors mounted to control said pressure die and clamp die.

8. The bending machine of claim 3 including a plurality of said bending dies, comprising a separate pressure die for each of said bending dies.

9. The bending machine of claim 3 wherein said at least one bend die comprises a plurality of vertically aligned bend dies, and said clamping die means comprises a separate clamp die horizontally aligned with each said bend die.

* * * * *